US008184112B2

(12) United States Patent
Miller et al.

(10) Patent No.: US 8,184,112 B2
(45) Date of Patent: May 22, 2012

(54) INCREASING DYNAMIC RANGE OF DISPLAY OUTPUT

(75) Inventors: Michael E. Miller, Honeoye Falls, NY (US); Paula J. Alessi, Rochester, NY (US); John W. Hamer, Rochester, NY (US); Ronald S. Cok, Rochester, NY (US)

(73) Assignee: Global OLED Technology LLC, Wilmington, DE (US)

( * ) Notice: Subject to any disclaimer, the term of this patent is extended or adjusted under 35 U.S.C. 154(b) by 910 days.

(21) Appl. No.: 12/236,807

(22) Filed: Sep. 24, 2008

(65) Prior Publication Data

US 2010/0073338 A1 Mar. 25, 2010

(51) Int. Cl.
*G09G 5/00* (2006.01)

(52) U.S. Cl. ..... 345/205

(58) Field of Classification Search ..... 345/205, 345/600–605

See application file for complete search history.

(56) References Cited

U.S. PATENT DOCUMENTS

| | | | | |
|---|---|---|---|---|
| 4,769,292 | A | 9/1988 | Tang et al. | |
| 5,061,569 | A | 10/1991 | VanSlyke et al. | |
| 6,693,611 | B1 | 2/2004 | Burroughes | |
| 6,717,698 | B1 | 4/2004 | Lee | |
| 6,778,183 | B1 * | 8/2004 | Nair et al. | 345/589 |
| 6,861,155 | B2 | 3/2005 | Bawendi et al. | |
| 6,897,876 | B2 | 5/2005 | Murdoch et al. | |
| 7,106,505 | B2 | 9/2006 | Whitehead et al. | |
| 7,230,594 | B2 | 6/2007 | Miller et al. | |
| 2005/0035974 | A1 * | 2/2005 | Nair et al. | 345/589 |
| 2005/0140612 | A1 * | 6/2005 | Baek | 345/83 |
| 2006/0082689 | A1 * | 4/2006 | Moldvai | 348/678 |
| 2007/0057263 | A1 | 3/2007 | Kahen | |
| 2007/0064162 | A1 * | 3/2007 | Yamamoto et al. | 348/790 |
| 2007/0139437 | A1 * | 6/2007 | Boroson et al. | 345/590 |
| 2009/0002564 | A1 | 1/2009 | Barnhoefer et al. | |

OTHER PUBLICATIONS

Lee et al, TFT-LCD with RGBW color system, SID 03 Digest, 1212, 2003.

Wang et al, Trade-off between luminance and color in RGBW displays for mobile-phone usage, SID 07 Digest, 1143-1145, 2007.

Lagendijk et al, Dynamic Wide-Color-Gamut RGBW Display, SID 07 Digest, 1458-1461, 2007.

* cited by examiner

*Primary Examiner* — Nitin Patel
*Assistant Examiner* — Andrew Schnirel
(74) *Attorney, Agent, or Firm* — McKenna Long & Aldridge LLP

(57) ABSTRACT

A method of controlling an RGBW electroluminescent display system that receives a three-component input image signal having triplets of intensity values in an image range and a highlight range includes transforming at least one of the triplets having an intensity value within the image range to a four-or-more-component drive signal to produce a luminance less than the sum of the corresponding luminance values of the red, green and blue light-emitting elements and transforming at least one of the intensity values within a triplet having an intensity value within the highlight range to a four-or-more-component drive signal to produce a luminance greater than the sum of the corresponding luminance values of the red, green, and blue light-emitting elements.

18 Claims, 11 Drawing Sheets

INCREASING DYNAMIC RANGE OF DISPLAY OUTPUT

FIELD OF THE INVENTION

The present invention relates to emissive displays that receive high-dynamic range signals for display and provide an expanded luminance and dynamic range for such signals.

BACKGROUND OF THE INVENTION

Most image systems attempt to render scenes with respect to a reference point, which is often specified in terms of a specific chromaticity position and peak luminance. One such reference point is the white point of the display, although other reference values can be used. Rendering scenes to a display in this way permits the image to be rendered using a relative specification rather than rendering a scene to absolute scene luminance values.

Generally, rendering a scene in terms of relative values results in images with high-perceived quality because the human visual system adapts to its environment and is therefore much better at determining relative, rather than absolute luminance values. This ability to use such a relative rendering process is very important in the imaging industry as it permits high-quality images to be produced in systems that are capable of presenting the human eye with a much smaller range of luminance values than exist in real world scenes. Thus, high quality images can be rendered on display systems that provide a much smaller range of luminance values than exist in real world environments. However, the image quality of rendered images on an electronic display can be improved by properly rendering high-dynamic-range images on displays capable of producing a larger range of luminance values than those produced by typical video display systems Today, most image-capture systems attempt to define a reference point, such as an 18% gray card illuminated by a source simulating a standard illuminant, such as CIE standard illuminant D65. This 18% gray card is then often assumed to have a perceived lightness value, specified in terms of CIE LAB L*, of about 50, meaning that it has a perceived lightness of about 50% of the white point luminance defined by a the luminance of perfect white diffuser illuminated with the same illumination as the 18% gray card reference within the scene that is being captured. The luminance and chromaticity coordinates of this perfect white diffuser within the ambient viewing environment, referred to as the scene reference white point, infers the white point within the imaging system. It is possible, however, for scenes to contain objects having luminance values that are higher than the luminance value of the scene reference white point and these higher luminance objects should, therefore, be rendered with L* values greater than 100. That is to say, that an output device, such as an electronic display, should display these objects to have higher luminance values than the luminance value at which the scene reference white point is displayed.

Several conditions can occur in natural scenes which result in L* values greater than 100. For example, backlit, fluorescent, and self-luminous objects within a scene can have higher luminance values than the scene reference white point. For example, the sun within a sunrise or sunset picture can have luminance values in excess of 50 times the luminance of a reference white within that scene. The direction of light can also produce scene luminance values greater than the scene reference white point as directional, e.g. specular, reflections, can be significantly higher in luminance than diffuse reflections. Similarly, these reflections can be 50 or more times greater than the scene reference white point. Further, many scenes can be illuminated by multiple illumination sources having different intensities or portions of scenes can be shaded. When the capture system selects the scene reference white point relative to a portion of the scene that is illuminated with a lower intensity, other areas of the scene, which are illuminated at a higher intensity, can contain many luminance values greater than luminance of the scene reference white point.

Traditional display systems are not only incapable of producing the full luminance range that occurs in natural scenes, but typically can not produce the dynamic range (i.e., ratio of maximum scene luminance to minimum scene luminance) that occurs in natural scenes, regardless of absolute luminance. Therefore, the system designer must decide how to compress the dynamic range of the scene to provide a pleasing rendition. Typically, this is accomplished by compressing the log of the scene luminance range into a smaller log luminance range on the final display as log luminance provides a better indication of perceived brightness. This rendition often assigns a significantly different average luminance to the displayed image than the average scene luminance, by rendering the average log scene luminance near the average log display luminance. Further, this rendering typically reduces the slope of the function relating log scene luminance to log display luminance through a rendering curve. This rendering curve is not linear but instead typically has a much lower slope in the region that corresponds to both the high and low luminance areas of the original scene. These regions of lower slope will be referred to as highlight and shadow regions, respectively. This is typically the most desired rendition as it permits objects having log scene luminance values near the average log scene luminance to be differentiated in the rendered scene but forces a large range of original log scene luminance values to be rendered within a relatively small log luminance range on the display. This rendering is typically desired, since for the average image, a small percentage of the spatial area of the image having high dynamic range is rendered into these highlight and shadow regions. However, displaying the information within the highlight regions of an image can significantly improve the appearance of a displayed image. Therefore many data encoding standards permit the encoding of information that have L* values greater than 100. For example, ITUR BT709-5 specifies an encoding from scene luminance to camera code values for the motion picture industry. Such an image encoding method is represented by the curve 2 shown in FIG. 1. As shown, this curve 2 represents scene luminance values between near 0 and 1.07, relative to the reference scene white point. These values are encoded such that a relative scene luminance value of 1.07 is assigned a code value of 255 as indicated by the point 4 on the curve 2. A relative scene luminance value of 1.0, which corresponds to the reference scene white point, is assigned a code value of 247 as indicated by the point 6 on the curve 2.

Two approaches or a blend of these two approaches have been taken when rendering these images to a traditional display. The first of these is to map the reference scene white point, often represented by a relative scene luminance value of 1.0, to the reference white point of the display. Using this approach, code value 247 can be mapped to the white point of the display, permitting the code values between 0 and 247 to be rendered with relatively high luminance. Unfortunately, the luminance of all of the code values above 247 will be clipped to the luminance of the display reference white point since the display is incapable of displaying code values above 247 with a higher luminance. This rendering approach results in a loss of information for all objects having scene luminance values higher than the scene luminance value of the reference perfect white diffuser, which reduces the image quality of the resulting image. Alternatively, the maximum relative scene luminance value provided within the encoding scheme can be mapped to the reference white point of the display, rendering the scene reference white point to a lower luminance than the reference white point of the display. Using this approach, the image will have an overall lower average luminance, sometimes resulting in lower perceived image quality.

Recently, high-dynamic-range displays have been demonstrated as discussed by Whitehead et al. in U.S. Pat. No. 7,106,505, entitled "High Dynamic Range Display Devices". These displays can provide a dynamic range of 10,000:1 or better and can often produce white luminance values of 1000 cd/m$^2$ or more. These displays enable images to be displayed with a much higher dynamic range than in traditional CRT, LCD, or Plasma displays that typically have dark-room contrast values of less than 1000:1 and rarely have white points above 500 cd/m$^2$. Unfortunately, the displays that have been demonstrated in this category to date are constructed from pairs of light modulators. These can include serial pairs of light blocking modulators such as LCDs or an addressable light source in combination with a light blocking modulator. In the direct-view-display market, such displays employing a high-density array of individually addressable, discrete, inorganic LEDs to backlight an LCD panel have been demonstrated. Forming such high-density arrays of discrete, inorganic LEDs is very process intensive and therefore very expensive. Further, electronics to permit these LEDs to be addressed independently also add significant cost to the overall display, making such displays too expensive to employ in the consumer marketplace. The same is true of other configurations that require multiple light modulators for serially blocking portions of the light from a less expensive uniform light source since the light modulators themselves are typically the most expensive component of any conventional display device.

Emissive displays, including coatable electroluminescent (EL) display technologies are also known in the art. Such coatable EL displays include an EL layer formed between a two-dimensional array of addressable electrodes. These devices can include EL layers employing purely organic small-molecule or polymeric materials, typically including organic hole-transport, organic light-emitting and organic electron-transport layers as described in the prior art, including U.S. Pat. No. 4,769,292, issued Sep. 6, 1988 to Tang et al., and U.S. Pat. No. 5,061,569, issued Oct. 29, 1991 to VanSlyke et al. The EL layer can alternately be formed from a combination of organic and inorganic materials, typically including organic hole-transport and electron-transport layers in combination with inorganic light-emitting layers, such as the light-emitting layers described in U.S. Pat. No. 6,861,155 issued Mar. 1, 2005 to Bawendi et al. Alternately, the EL layer can be formed from fully inorganic materials such as the devices described in co-pending U.S. Patent Application Publication No. 2007/0057263, published Mar. 15, 2007, entitled, "Quantum Dot Light Emitting Layer".

Coatable EL displays, being emissive displays, are capable of providing very low luminance blacks and can, therefore, have dynamic range values of 10,000:1 or more as measured using standard ANSI contrast measurements. However, because they are emissive displays, they tend to draw more power when rendering scenes to a high-luminance white point and the use of these high-luminance white points often limits the lifetime of the display. For this reason, luminance values above 500 nits are almost never applied. It is known, however, to create OLED displays having higher efficiencies by adding additional, higher efficiency emitters to the traditional RGB emitters typically employed in displays. Such displays have been discussed by Burroughes in U.S. Pat. No. 6,693,611, issued Feb. 17, 2004 and entitled "Display Devices" and Miller et al. in U.S. Pat. No. 7,230,594, issued Jun. 12, 2007 and entitled "Color OLED Display With Improved Power Efficiency". One such format of OLED that is desirable from a manufacturing perspective is the format discussed by Miller et al., which permits the OLED display to be formed from a blanket white emitter with subpixels, including red, green, and blue color filters, as well as subpixels that are not filtered to produce red, green, blue, and white subpixels. To produce accurate color in these displays the peak luminance of the white color channel is typically defined to be about equal to the sum of the peak luminance values for the RGB subpixels when they are balanced to achieve the color of the peak white emitter. This same constraint must be applied, however, regardless of the color of any additional primaries, if accurate color rendition is required for all possible rendered colors or the peak luminance values of any of these subpixels.

Prior art in the OLED or LCD field describes rendering images to displays having more than three colors of subpixels to increase the luminance of the display. However, these approaches tend to produce color errors for all colors displayed on such displays. For example, Lee et al, in TFT-LCD with RGBW color system, SID 03 Digest 1212 2003 discuss a transformation method for LCDs having red, green, blue and additional white subpixel. In this method, luminance from an additional white subpixel is added to every color, resulting in an image in which every color is desaturated. Wang et al. in a paper entitled "Trade-off between luminance and color in RGBW displays for mobile-phone usage", SID 07 Digest 1143-1145 2007 also discusses the problem of desaturating the content of the image in displays having more than four primaries, specifically red, green, blue and white primaries, and several methods of converting from a three-color input signal to a four or-more-color output signal for an LCD that results in various levels of image desaturation. Langendijk et al. also discuss desaturation in such displays in a paper entitled "Dynamic Wide-Color-Gamut RGBW Display" published in SID 07 Digest, 1458-1461, 2007. This paper also describes an expensive method for partially overcoming the problem in backlit LCDs wherein the color of the backlight is adjusted on an image-by-image basis to attempt to increase the effective color gamut of the display. Each of these methods add luminance from the white subpixel to the luminance produced by the red, green, and blue subpixels such that all or practically all colors rendered on the display are desaturated, often to the point that a lower-luminance, higher-saturation display is preferred to a display using such a rendering process for at least some images. However, these authors do not discuss the rendering of high-dynamic-range content on these displays and these displays are incapable of producing high-dynamic-range images due to the lack of extended bit depth beyond 8 bits and the inability of LCDs to produce dark enough blacks to achieve dynamic-range values above 1000.

In the OLED display art, it is recognized that the constraints are different for emissive displays than for LCDs as the emissive displays only use power to produce light, rather than modulating light from a backlight that consumes power regardless of the state of the modulator. Murdoch et al. in U.S. Pat. No. 6,897,876, published May 24, 2005 and entitled "Method For Transforming Three Color Input Signals To Four Or More Output Signals For A Color Display" discuss subtracting a portion of the signal from the RGB input signals and assigning this to drive an additional primary to provide a signal for driving a four-or-more-color display in a way that does not produce color error. However, to provide a signal for increasing the luminance of the display, this patent discusses adding different proportions of the subtracted portion to drive the additional primary than is subtracted from the RGB drive signals. As such, color error can be introduced for practically all colors, with the possible exception of fully-saturated colors. Also in the OLED display art, Boroson et al. in U.S. Patent Application Publication 2007/0139437 entitled "OLED Display With Improved Power Performance" describes a display and an image processing method in which the sum of the gamut-defining pixel peak luminance values (e.g., the peak luminance of the red, green, and blue subpixels), is less than the display peak luminance and wherein at least a portion of the display peak luminance is formed from a within-gamut pixel. As described, this higher display peak luminance is achieved by either desaturating the input image data for all colors or by limiting the peak red, green, and blue luminance values, reducing the luminance of the saturated colors. As described, the display peak luminance will typically be only slightly higher than the gamut-defining pixel peak luminance values, with all examples providing a display peak luminance less than 1.5 times higher than the sum of the peak red, green, and blue luminance values.

Therefore, a display is needed that is capable of producing higher dynamic-range images with higher peak-brightness values. Ideally, such a display would provide a dynamic range greater than 10,000:1 on a pixel-by-pixel basis with a peak luminance of 1000 cd/m$^2$ or greater. Such a display would ideally render images with accurate color and yet permit colors that are higher in luminance than the luminance of the reference white diffuser to be rendered with a luminance that is higher than the luminance of the display white point.

SUMMARY OF THE INVENTION

One aspect of the present invention includes a method of controlling an electroluminescent display system that receives a three-component input image signal having triplets of intensity values, the intensity values having at least an image intensity range and a highlight intensity range, the smallest intensity value of the highlight range being greater than the greatest intensity value of the image range, including:

(a) providing a plurality of light-emitting elements for emitting red, green, and blue light and at least one additional light-emitting element for emitting at least one additional color of light, the luminance of the emitted light being responsive to a current provided to each light-emitting element; and (b) controlling the current to each light-emitting element to cause each light-emitting element to produce a corresponding luminance value, wherein the corresponding luminance value of the at least one additional light-emitting element is greater than the corresponding luminance value of at least one of the red, green, or blue light-emitting elements at the same current;

(c) transforming the received three-component input image signal to a four-or-more-component drive signal and providing the four-or-more-component drive signal to control the current to each light-emitting element; and (i) transforming at least one of the triplets having an intensity value within the image range to a four-or-more-component drive signal to produce a luminance less than the sum of the corresponding luminance values of the red, green and blue light-emitting elements; and (ii) transforming at least one of the intensity values within a triplet having an intensity value within the highlight range to a four-or-more-component drive signal to produce a luminance greater than the sum of the corresponding luminance values of the red, green, and blue light-emitting elements.

The present invention improves the dynamic range and peak luminance of electroluminescent displays to permit high dynamic range image content to be displayed without significantly increasing the power consumption of the display. These benefits are provided without making dramatic or expensive modification to known display structures.

DETAILED DESCRIPTION OF THE INVENTION

The need is met by providing a method of controlling an electroluminescent display system that receives a three-component input image signal having a triplet of intensity values and transforming the three-component input image signal to a four-or-more-component drive signal for driving an EL display having red, green, and blue light-emitting elements and at least one additional light-emitting element to produce a high-luminance, high-dynamic-range image. The method of the present invention includes the steps shown in FIG. 4.

Figure 4:
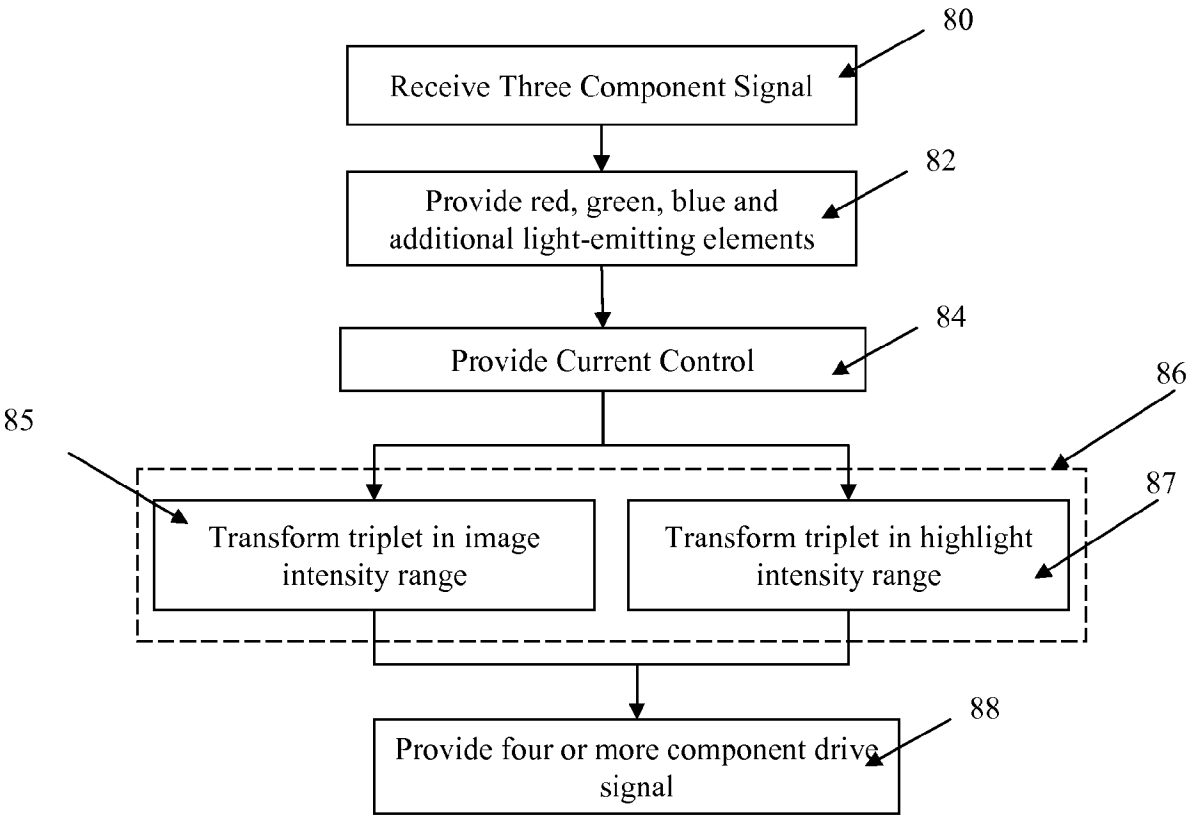
FIG. 4 is a flow diagram depicting the steps of the present invention.

As shown in FIG. 4, a three-component input image signal having a triplet of intensity values is received (step 80). The intensity values include at least an image range and a highlight range wherein the smallest intensity value of the highlight range is greater than the greatest intensity value of the image range so that the two ranges are disjoint. A plurality of light-emitting elements for emitting red, green, and blue light and at least one additional light-emitting element for emitting at least one additional color of light are provided (step 82). The luminance of the emitted light produced by each light-emitting element is responsive to the current, which is provided to each light-emitting element. The current to each light-emitting element is controlled (step 84) to cause each light-emitting element to produce a corresponding luminance value, wherein the corresponding luminance value produced by the at least one additional light-emitting element is greater than the corresponding luminance value produced by the at least one of the red, green, or blue light-emitting elements at the same current. The received three-component input image signal is transformed (step 86) to a four-or-more-component drive signal. This transforming step (step 86) includes transforming (step 85) at least one of the triplets having an intensity value within the image range to a four-or-more-component drive signal to produce a luminance less than the sum of the corresponding luminance values of the red, green and blue light-emitting elements. Additionally, at least one of the intensity values within a triplet having an intensity value within the highlight range is transformed (step 87) to a four-or-more-component drive signal to produce a luminance greater than the sum of the corresponding luminance values of the red, green, and blue light-emitting elements. The four-or-more component drive signal is provided (step 88) to control the current to each light-emitting element. Through this method, triplets having an intensity value within the highlight range result in a four-or-more component drive signal that uses the at least one additional light-emitting element to produce luminance values that are higher than the luminance produced for a triplet having an intensity value within the image range.

In at least some embodiments, the one or more additional light-emitting elements are capable of providing light that is within the gamut defined by chromaticity coordinates of the light emitted by the red, green, and blue light-emitting element and specifically is near the display white point. By stating that the chromaticity coordinates are near the chromaticity coordinates of the display white point, it is implied that if one additional light-emitting element is provided, it will have chromaticity coordinates that are within a distance of 0.1 units in the 1976 CIE uniform chromaticity scale diagram of the chromaticity coordinates of the display white point. If more than one additional light-emitting element is provided then a line or area formed by connecting the chromaticity coordinates of these light-emitting elements will include chromaticity coordinates that are within 0.1 units in the 1976 CIE uniform chromaticity scale diagram of the chromaticity coordinates of the display white point. The display white point is defined as the color that is created by providing equal red, green, and blue three-component color signal values to the display.

The ability to create light that is near the display white point can be important since specular reflections have been shown to have chromaticity coordinates nearly equal to the chromaticity coordinates of the illumination source, which is often rendered to match the display white point. Further, it is known that objects illuminated by higher intensity illumination sources often are lower in saturation than objects illuminated by lower intensity illumination sources and therefore have chromaticity coordinates inside the color gamut of objects in the image range. For each of these reasons, the distribution of chromaticity coordinates for objects having scene luminance values greater than the luminance of the scene reference white point, can be expected to be biased towards the display white point, that is, they can be expected to be less saturated in color and nearer the display white point than objects having scene luminance values lower than the luminance of the scene reference white point. This can be particularly true for objects having scene luminance values that are significantly higher than the luminance of the scene reference white point since specular reflections will often produce luminance values that are much higher than luminance of the scene reference white point.

Figure 1:
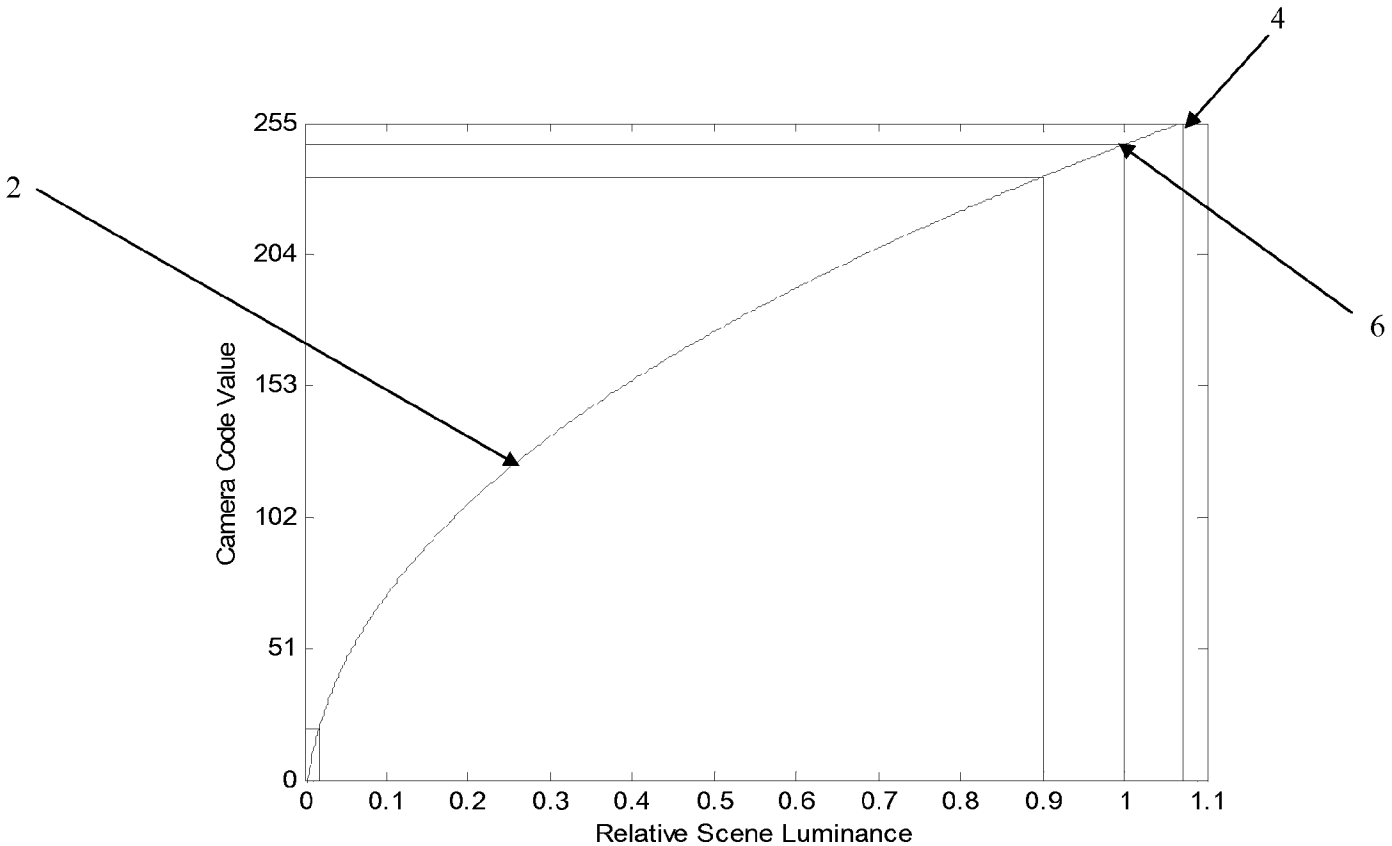
Fig. 1 (Prior Art)
FIG. 1 is a graph depicting a relationship between a camera code value and relative scene luminance as known in the prior art.
Figure 2:
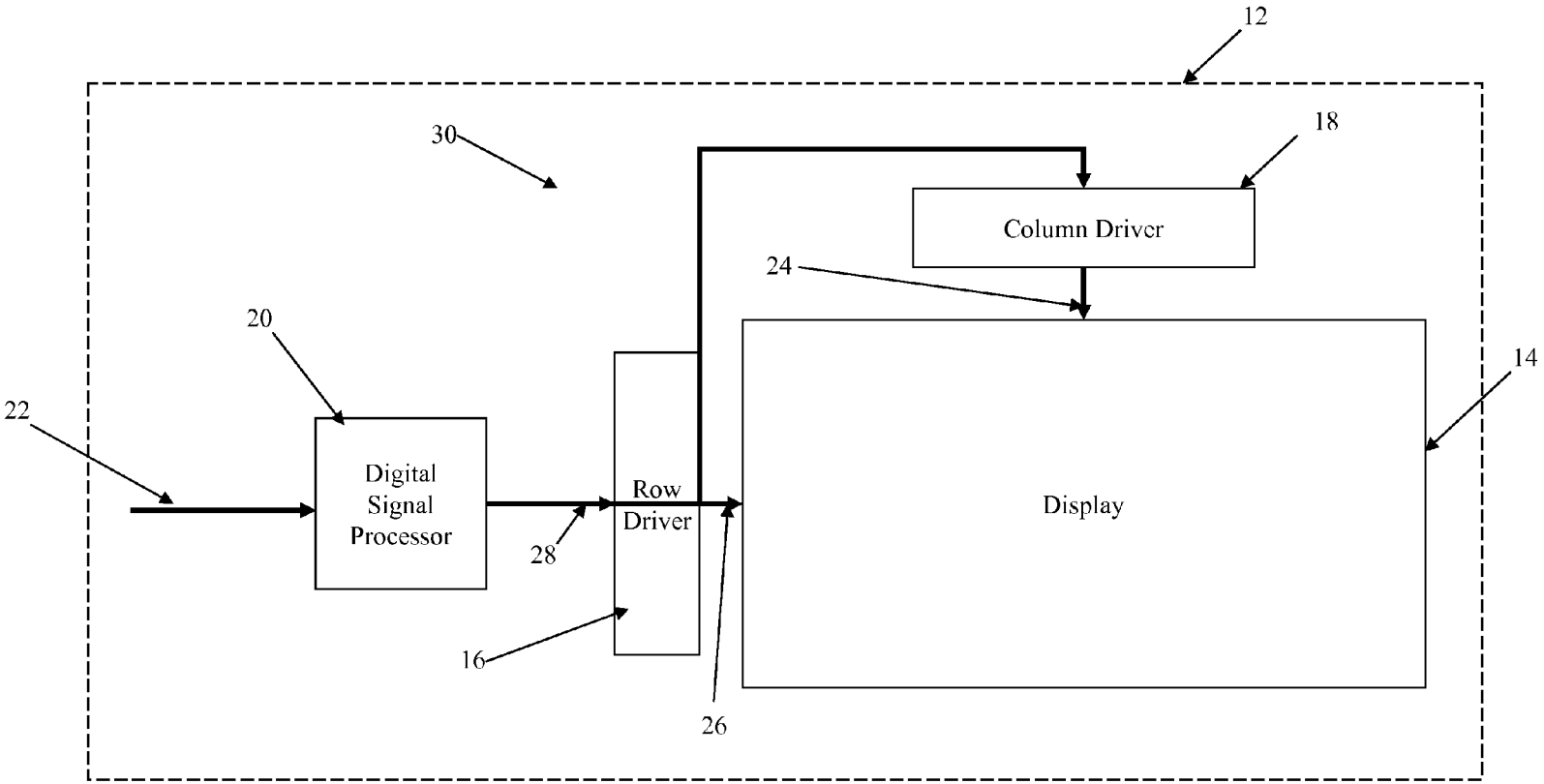
FIG. 2 is a schematic diagram of a display system useful in practicing the present invention.
Figure 3:
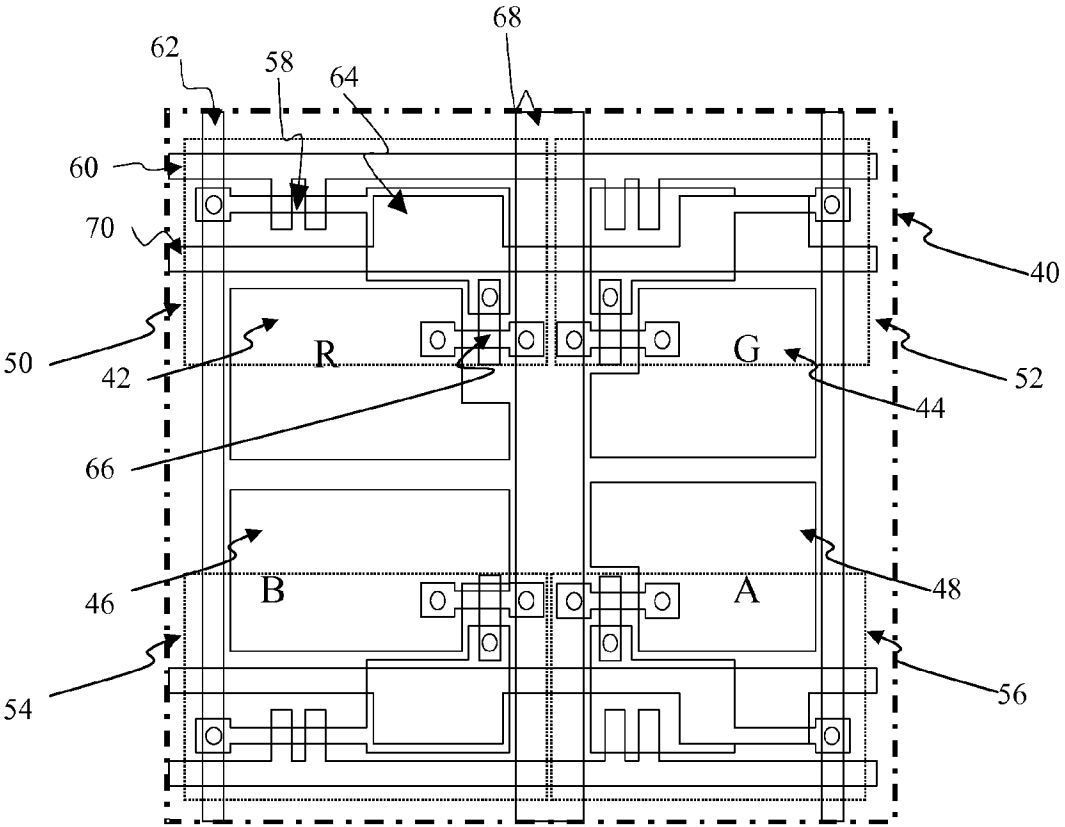
FIG. 3 is a plan view of a portion of an electroluminescent display useful in practicing the current invention.

To fully appreciate this method, it is useful to discuss a typical display system in which this method can be applied. One such system is shown in FIG. 2. Referring to FIG. 2, an electroluminescent display system 12 includes an electroluminescent display 14, a portion 40 of which is shown in more detail in FIG. 3. As shown in FIG. 3, the display portion 40 includes a plurality of light-emitting elements 42, 44, 46 for emitting red, green, and blue light, respectively, and at least one additional light-emitting element 48 for emitting at least one additional color of light. In one example, the additional light-emitting element 48 will emit white light. In this display, the luminance of the light produced by these light-emitting elements is responsive to a current provided to each light-emitting element 42, 44, 46, and 48.

The display additionally includes one or more circuits 50, 52, 54, and 56 for controlling the current to each light-emitting element 42, 44, 46, 48. Each circuit provides a corresponding current to each light-emitting element 42, 44, 46, 48 to cause each light-emitting element 42, 44, 46, 48 to produce a corresponding luminance value. Within this invention, the corresponding luminance value of the at least one additional light-emitting element 48 within the display 14 is greater than the corresponding luminance value of at least one of the red, green, or blue light-emitting elements at the same current. As will be discussed in more detail later, the voltage on a capacitor 64, the current and voltage on a power line 68 and the physical characteristics of a power TFT 66 primarily determine the current provided to each light-emitting element.

Within this disclosure the terms "corresponding current" and "corresponding luminance" are applied. Corresponding currents for the red 42, green 44, and blue 46 light-emitting elements are the currents that are required to drive the light-emitting elements 42, 44, and 46 to provide the reference white point of the display (i.e., the luminance and chromaticity coordinates of the display white point). In some display configurations, the corresponding currents for the red 42, green 44, and blue 46 light-emitting elements will be the maximum current that can be provided to these light-emitting elements. However, it is not required that these currents be at their maximum but will be the currents required to drive the display in response to a signal corresponding to a perfect white diffuser within the scene (i.e., signals corresponding to an input intensity of 1). The corresponding current of the additional light-emitting element is equal to the minimum of the corresponding currents of the red 42, green 44, or blue 46 light-emitting elements. The corresponding luminance is the luminance that is produced by either the light-emitting element or a sum of the individual light-emitting elements in response to the corresponding currents of one or all of the light-emitting elements.

Referring back to FIG. 2, the display system additionally includes one or more display drivers 16, 18, 20. The display driver(s) receive (Step 80 in FIG. 4) the three-component input image signal 22 and transforms (Step 85 in FIG. 4) at least one of the triplets having an intensity value within the image range to a four-or-more-component drive signal that produces a luminance less than the sum of the corresponding luminance values of the red, green and blue light-emitting elements and transforms (Step 87 in FIG. 4) at least one of the intensity values within a triplet having an intensity value within the highlight range to a four-or-more-component drive signal that produces a luminance greater than the sum of the corresponding luminance values of the red 42, green 44, and blue 46 light-emitting elements. The display drivers provide the four or more component drive signals to the circuits (50, 52, 54, 56 in FIG. 3) that provide current to the light-emitting elements (42, 44, 46, 48 in FIG. 3) causing the light-emitting elements to produce light with the desired luminance.

Within this disclosure, the terms "image range" and "highlight range" each refer to disjoint combinations of intensity values. Generally, the image range will include triplets of intensity values in which each of the red, green, and blue intensity values are less than or equal to the red, green and blue intensity values that are used to form a color at the display white point (i.e., the intensity values at which a perfect white diffuser within a captured scene is rendered). The highlight range typically will include triplets of intensity values in which at least one of the red, green, and blue intensity values are greater than the red, green, and blue intensity values that are used to form a color at the display white point.

This EL display system 12 can provide a dynamic range greater than 100,000:1 on a pixel-by-pixel basis with a peak luminance of 1000 cd/m$^2$ or greater. As will be discussed in more detail, this is accomplished by employing the redundancy provided by the at least one additional light-emitting element 48 to provide higher luminance values than could be achieved by combining the light output of the red 42, green 44, and blue 46 light-emitting elements, thus increasing the dynamic range of the display. When a high-dynamic-range signal is input to the display system as the three-component input image signal 22, a perfect white diffuser within the original scene can be rendered using corresponding currents for the red 42, green 44, and blue 46 light-emitting elements, resulting in corresponding luminance values that will typically be near the sum of the maximum luminance values of the red, green and blue light-emitting elements. Therefore, triplets representing lower luminance objects in the original scene than a perfect white diffuser (i.e., the triplets having an intensity value within the image intensity range), will generally be rendered to luminance values lower than the corresponding luminance values of the red, green and blue light-emitting elements. Further, triplets representing higher luminance objects in the original scene than a perfect white diffuser (i.e., the triplets having an intensity value within the highlight range) will generally be rendered to luminance values higher than the corresponding luminance, which will typically be near the sum of the maximum luminance values of the red, green and blue light-emitting elements.

In some embodiments, the corresponding luminance value of the at least one additional light-emitting element 48 is greater than the sum of the corresponding luminance values of the red 42, green 44, and blue 46 light-emitting elements (i.e., the corresponding luminance of at least one additional light-emitting element 48 will be higher than the luminance of the display white point). As such this at least one additional light-emitting element 48 can be used to provide substantial increases in the dynamic range of the display. In fact, it can be desirable for the sum of the maximum luminance values for the additional light-emitting elements 48 within the display 14 to be more than 2 or 3 times the sum of the corresponding luminance values for all of the red 42, green 44, and blue 46 light-emitting elements within the display.

The present invention can be illustrated through a specific example. In this example, the display system 12, shown in FIG. 2, of the present invention, will be provided (Step 82 in FIG. 4). The three-component input image signal 22 will be received (step 80 in FIG. 4) by the digital signal processor 20 shown in FIG. 2. The digital signal processor 20 will transform (step 86) the three-component input image signal 22 to a four-or-more-component drive signal 30, which in typical active-matrix displays will be provided to a column driver 18. Often this signal will be a digital signal but it could be an analog signal. The digital signal processor 20 will typically also provide a timing signal 28 to a row driver 16. The column driver 18 will typically convert each digital signal it receives to an analog signal 24 provided to the data lines of the display 14, such as data line 62 in FIG. 3. The row driver 16 will typically produce analog signals and provide these analog signals to the row lines of the display 14, such as row line 60 in FIG. 3. These analog signals 24 will control the flow of current within the display 14 to control the luminance of each of the light-emitting elements in the display.

In the present example, the display 14 is an active-matrix display, such as illustrated by the portion of an n-channel active matrix display shown in FIG. 3, which has individual circuits 50, 52, 54, 56 for controlling the current to each light-emitting element 42, 44, 46, and 48 within the display 14. However, one skilled in the art will recognize that the display 14 can also be a p-channel active matrix display or a passive-matrix display having circuits within row 16 and column 18 drivers for directly controlling the current to each light-emitting element 42, 44, 46, and 48 of the display 14. In the active-matrix display of the present example, the analog signal provided by the row driver 16 establishes a voltage on a row line 60 connected to a row of select TFTs, including a select TFT 58, to permit analog voltage signals provided by the column driver 18 to flow through the select TFTs 58 connected to the row line 60, while establishing a voltage on all other row lines within the display to prevent the same analog signal from flowing through other select TFTs within the display 14. The amplitude of the voltage on the data line, which varies as a function of the desired current, flows through the select TFT 58 and charges the capacitor 64 with respect to the voltage on the capacitor line 70. Once this capacitor 64 is charged for each light-emitting element 42, 46 connected to the row line 60, the row driver 16 changes the analog signals to permit the column driver 18 to provide a different voltage to another row of circuits within the display. As the column driver provides unique voltage values to each data line 62 within the display 14 during the time the row driver activates each row of select TFTs 58, unique voltages are provided to each circuit 50, 52, 54, 56 of the display 14. As the capacitor 64 is charged a voltage is provided at the gate of a power TFT 66. As this voltage is changed, greater or lesser amounts of current can flow from the power line 68, through the power TFT 66 and to the light-emitting element 42.

In this display, the maximum current that can be provided from the power line 68 to the light-emitting element 42 is limited to a maximum value. This maximum value can be influenced by factors, including the maximum voltage range that the column driver 18 can provide at the select TFT 58, the time that is provided to charge the capacitor 64 and the size and mobility of the power TFT 66. However, independent of the limiting factor, each light-emitting element 42, 44, 46, and 48 within the display 14 will provide a maximum luminance in response to the maximum digital value of the four-or-more-component drive signal 30 provided by the digital signal processor 20 to the column driver 18. Therefore, in the current example, the electroluminescent display is an active-matrix display and a circuit is associated with each light-emitting element to provide a maximum current to each light-emitting element to cause each light-emitting element to produce a maximum luminance value. The corresponding current for each light-emitting element must, therefore, be equal to or less than the maximum current that can be provided to each light-emitting element. Often, the corresponding current for at least one of the red 42, green 44, or blue 46 light-emitting elements will equal the maximum current for the respective light-emitting element to minimize the voltage and maximize the power efficiency of the display.

In the present example, the light-emitting elements of the display 14 will include red 42, green 44, and blue 46 light-emitting elements for emitting red, green, and blue light. The display will additionally include at least one additional light-emitting element 48 for emitting white light. That is, the additional light-emitting element 48 emits substantially white light.

Figure 5:
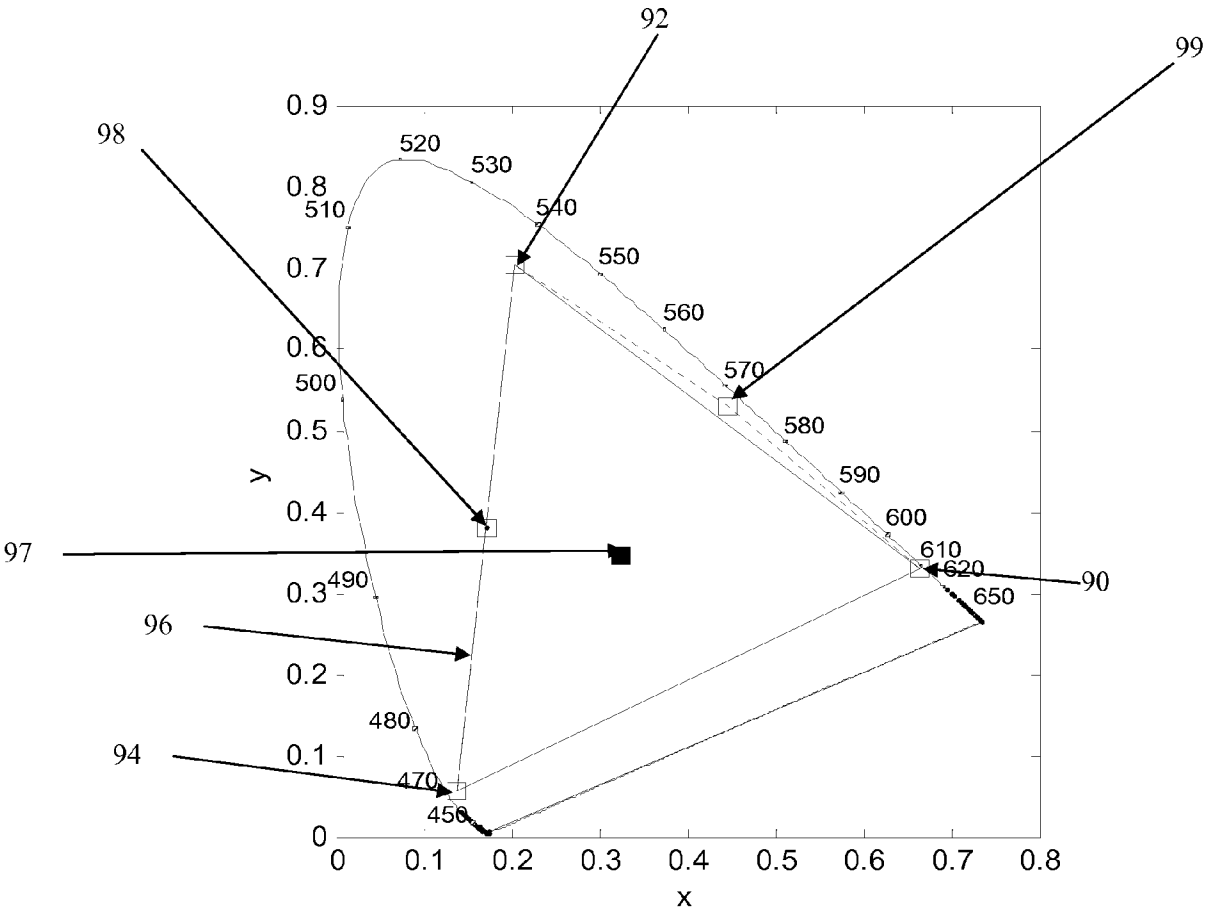
FIG. 5 is a CIE 1931 chromaticity diagram depicting coordinates of light-emitting elements useful for practicing the present invention.

FIG. 5 shows chromaticity coordinates 90, 92, 94 of the light produced by the red 42, green 44, and blue 46 light-emitting elements of the display in the present example plotted within a CIE 1931 chromaticity diagram. The chromaticity coordinates 90, 92, 94 of the light produced by these light-emitting elements define a color gamut 96. The white light-emitting element 48 in this example will be assumed to have chromaticity coordinates 97. To simplify this example, it will be assumed that the chromaticity coordinates 97 of this white light-emitting element 48 equal the chromaticity coordinates of the display white point (i.e., the chromaticity coordinates at which the display system will render white objects in an input scene). Although the additional light-emitting element 48 of the current example will emit white light having the chromaticity coordinates 97, the current invention requires that the additional light-emitting element have chromaticity coordinates that are significantly different (i.e., have a distance greater than 0.1 units within the 1976 CIE uniform chromaticity space) than the chromaticity coordinates 90, 92, 94 of the red, green, and blue light-emitting elements 42, 44, 46. Therefore, other examples can be formed wherein the one or more additional light-emitting elements 48 have chromaticity coordinates such as 98, which lies on the color gamut boundary, or chromaticity coordinate 99, which lies outside the color gamut boundary.

Figure 6:
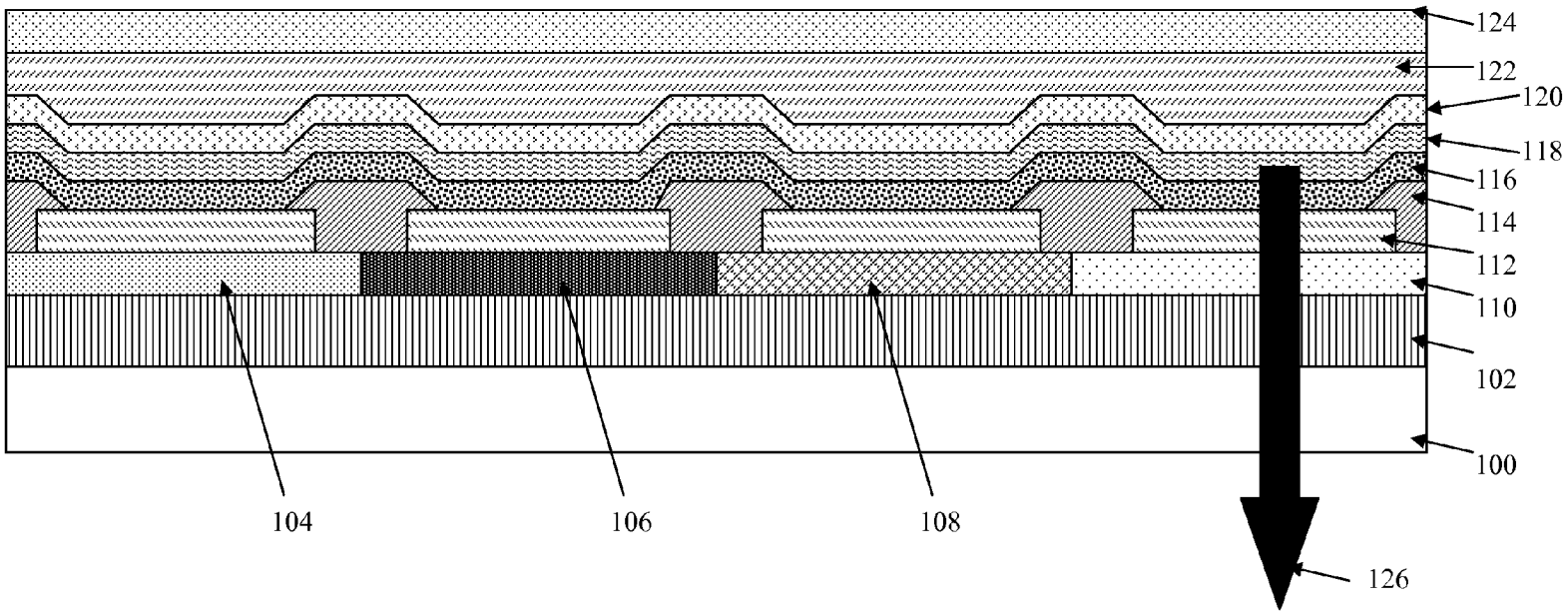
FIG. 6 is a partial cross section of an EL display useful for practicing the present invention.

As shown in FIG. 3, the circuits 50, 52, 54, and 56 contain equally sized components and will provide approximately equal maximum currents to each of the light-emitting elements 42, 44, 46, and 48. In other embodiments o the present invention, the components and areas of the light-emitting elements can differ. In any case, the maximum luminance of each of the light-emitting elements is influenced not only by the maximum current provided by each circuit but also by the luminous efficiency of each color of light-emitting element. A cross section of a display of the present example in which the arrangement of light-emitting elements has been modified and simplified for ease of illustration is shown in FIG. 6. As shown in this figure, the display of the present example will include a substrate 100 and an active-matrix layer 102, which contains the circuits 50, 52, 54, and 56. Color filters 104, 106, and 108 for filtering the white light generated a the EL layer within this display to form red, green, and blue light will be formed over this active-matrix layer 102. This layer 102 will typically include multiple layers of materials some of which will be patterned to permit light to pass through regions in this layer. A transparent element 110 or a smoothing layer is also applied within this layer to provide a transparent region for the emission of white light while also providing a smooth surface on which to construct subsequent layers. A layer 112 of independently addressable electrodes are placed over these color filters and connected to the circuits of the active-matrix layer 102. A pixel-definition layer 114 is formed over the electrodes. The electroluminescent layers includes a hole-transport layer 116, a light-emitting layer 118 and an electron-transport layer 120. A second electrode layer 122 and an encapsulation layer 124 are also applied. In this device, the light-emitting layer 118 produces white light in response to the current that passes between the electrode layers 112 and 122. The area of emission for each light-emitting element is defined by the presence of electrode material within the layer of independently-addressable electrodes 112 and pixel definition layer 114. The white light is filtered by the red 104, green 106, and blue 108 color filters, and passes through the layers between the emission layer 118 and the substrate 100 and then emitted from the display in a light direction 126. Therefore, each of these color filters 104, 106, 108 reduce the luminance of the light that is produced by the light-emitting layer 118 differentially. Hence, each of these red, green, and blue light-emitting elements has different luminance efficiencies and, therefore, a different maximum luminance. Additionally, the white light will provide a white light-emitting element having a maximum luminance greater than the maximum luminance of the red, green, or blue light-emitting elements. In this example the maximum luminance of the white light-emitting element will be two times the sum of the maximum luminance produced by the red, green, and blue light-emitting elements, which is typical for a display having light-emitting elements with the chromaticity coordinates shown in FIG. 5. Table 1 shows the 1931 CIE chromaticity coordinates for each of the light-emitting elements of the display in the present example. Also shown are the maximum luminance values for each light-emitting element, wherein the sum of the maximum luminance values produced by the red 42, green 44 and blue 46 light-emitting elements is 500 cd/m$^2$. It should be noted, however, that while each of the light-emitting elements can produce the maximum luminance values shown, these maximum luminance values cannot all be used together to produce the color of the display white point. In this example, the red, green, and blue light-emitting element luminance values that can be applied to produce a white color at the display white point of 0.313, 0.329 (i.e., the corresponding luminance values) are 131.7, 281.7, and 31.6 for a total luminance of 445 cd/m$^2$ at the display white point. Note that while the maximum blue luminance value can be applied to form the maximum luminance at the display white point, both the red and green light-emitting elements can produce luminance values greater than are required to produce the highest luminance at the display white point.

TABLE 1

1931 chromaticity coordinates for each light-emitting element with maximum luminance values.

| Light-Emitting Element | x chromaticity coordinate | y chromaticity coordinate | Maximum Luminance (cd/m$^2$) |
|---|---|---|---|
| Red | 0.665 | 0.331 | 144.9 |
| Green | 0.204 | 0.704 | 323.9 |
| Blue | 0.139 | 0.057 | 31.6 |
| White | 0.313 | 0.329 | 1000.0 |

In this example, it will further be assumed that the minimum luminance that can be produced by the sum of the light from all four light-emitting elements 42, 44, 46, 48 will be 0.010 cd/m$^2$ when measured in a dark room, a value that is also typical for an organic light-emitting display with this structure. Thus when the white light-emitting elements are driven at their maximum luminance values, the white color channel alone will have a dynamic range of 100,000:1. Although displays are known in the art having red 42, green 44, blue 46 and at least one additional light-emitting element 48, the additional light-emitting element found in the prior-art typically does not produce significantly higher luminance values than each of the other light-emitting elements and seldom is capable of producing luminance values greater than the sum of the maximum luminance of the red 42, green 44, and blue 46 light-emitting elements. Therefore, the dynamic range of prior-art displays is defined by the ratio of the combined red, green, and blue corresponding luminance values and the black level. That is, corresponding displays of the prior art typically have a dynamic range of approximately 445 $cd/m^2$:0.010 $cd/m^2$ or around 45,000:1. It is notable that in the design shown, the color filters on the red, green, and blue light-emitting elements provide very saturated colors, while the white light-emitting element is unfiltered and thus retains a very high efficiency. Therefore, the efficiency of the at least one additional light-emitting element is significantly greater than the efficiency of the red, green, and blue light-emitting elements.

It should further be noted that prior-art displays are not driven to produce luminance values that are 2 times the sum of the corresponding luminance of the red 42, green 44, and blue 46 light-emitting elements because such a drive scheme using transform techniques known in the art result in desaturated images that significantly reduce image quality. However, it has been observed that the present invention is particularly advantaged when maximum luminance value of the at least one additional light-emitting element 40, (the white light-emitting element in this example) is several multiples of the sum of the corresponding luminance values of the red 42, green 44, and blue 46 light-emitting elements. When comparing the maximum luminance value of the additional light-emitting element 48 to the sum of the corresponding luminance values of the red 42, green 44 and blue 46 light-emitting elements, it is not necessary that the maximum luminance produced by individual light-emitting elements fulfill this criterion but that the average luminance produced by the display when driving each of the light-emitting elements 42, 44, 46, 48 in the display 14 to their maximum value fulfill this criterion.

Several design modifications can be made to the display to further increase the ratio of the maximum luminance of the light produced by the one or more additional light-emitting elements to the sum of the corresponding luminance values of the red, green, and blue light-emitting elements. These design modifications include forming a larger number of the one or more additional light-emitting elements 48 than red 42, green 44, or blue 46 light-emitting elements within the display 14 and designing the circuit 56 for driving the one or more additional light-emitting elements 48 to provide a higher maximum current than the maximum current provided by the circuits 50, 52, 54 for driving the red 42, green 44, or blue 46 light-emitting elements. For example, the area of the additional light-emitting element 48 can be larger than the area of the other light-emitting elements or the size of the power transistor can be larger than the driving transistors of the other light-emitting elements. As shown, when the transform step 86 of the present invention is applied in this display at least one triplet of image signal values can be rendered to have a luminance that is at least 2 times higher than the sum of the corresponding luminance values of the red 42, green 44, and blue 46 light-emitting elements.

In the display system 12 as shown in FIG. 2, the display 14 requires a four-or-more-component drive signal 30 to drive not only the red 42, green 44 and blue 46 light-emitting elements but the white light-emitting elements 48 as well. However, in this display system and most other traditional display systems, a three-component input image signal 22 including a triplet of intensity values to specify a color and luminance at each pixel location in the display, is received (step 80 in FIG. 4) by the digital signal processor 20. In this example, the three-component input image signal 22 can include one, or a video sequence of, files in OpenEXR format as specified by Industrial Light & Magic and described at http://www.openexr.com/index.html. This file format permits the entire luminance range of a scene to be encoded as a triplet of values (i.e., red, green, and blue), including the luminance values of objects in the scene having a lower or equal relative luminance than the luminance of a perfect white diffuser and the luminance values of objects in the scene having a higher relative luminance than a perfect white diffuser. Therefore, this three-component input image signal includes a triplet of intensity values, the intensity values having at least an image range and a highlight range, the smallest intensity value of the highlight range being greater than the greatest intensity value of the image range. Typically the scene reference white provides a demarcation between the image range and the highlight range with the image range including all values equal to or less than the demarcation and the highlight range including all values larger than the demarcation.

In this example, the digital signal processor 20 will receive a three-component input image signal for the bar harbor sunrise scene as described and provided at: http://www.cis.rit.edu/fairchild/HDRPS/Scenes/BarHarborSunrise.html. This three-component input image signal includes scaled XYZ tristimulus values for each pixel location within the BarHarborSunrise image. The digital signal processor 20 will then transform (step 86 in FIG. 4) this three-component input image signal 22 to a four-or-more-component drive signal 30 for driving the display.

Figure 7:
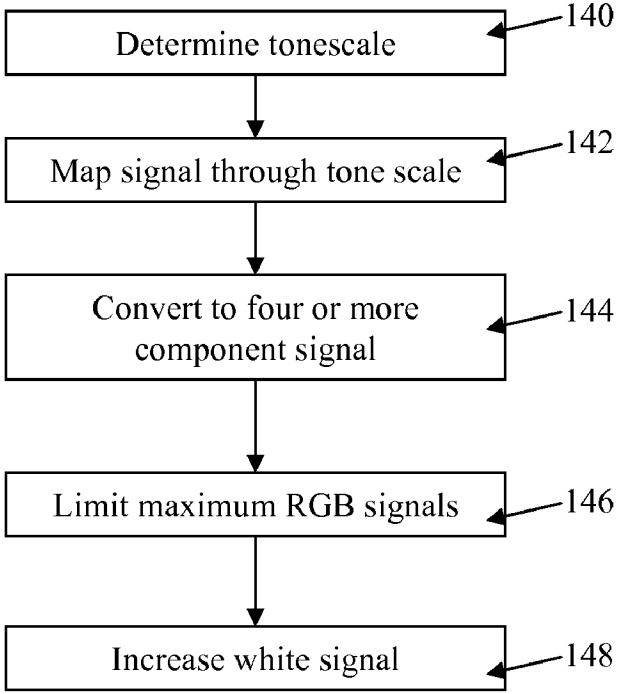
FIG. 7 is a flow diagram depicting a set of steps useful in providing the conversion step of the present invention.

The transform step 82 will generally include the steps shown in FIG. 7. First, a tone scale will be determined (step 140) to map the input image signal to an output image signal in which the scene reference white point (i.e., the luminance of a perfect white diffuser within the scene) is mapped to intensities corresponding to the display white point. These intensities are the same intensities required to generate the corresponding currents for the red 42, green 44, and blue 46 light-emitting elements, causing the display to produce the corresponding luminance values of 131.7, 281.7, and 31.6 $cd/m^2$, respectively, which are required to form the desired display white point as discussed earlier. The three-component input image signal is then mapped (step 142) to an output three-component image signal by applying this tone scale mapping. This mapping process will place the luminance of the scene reference white near or at the corresponding luminance values for the red, green, and blue light-emitting elements. Therefore, all, or at least the majority, of the image range will be mapped within a luminance regime that can be formed without color error by numerous combinations of the red, green, blue and white subpixels while the highlight range will be mapped to a higher luminance regime. The three-component input image signal will be converted (step 144) to a four-or-more-component image signal. The red, green and blue signals in the four-or-more-component image signal will then be limited (step 146) based upon the maximum luminance values of the red, green, and blue light-emitting elements, such that no signal will be provided to request a current higher than the maximum current for each light-emitting element. Finally, the white signal for the pixels in which the red, green or blue signals were limited will be increased (step 148) to compensate for at least a portion of the luminance loss incurred by limiting the red, green, and blue signals.

Figure 8:
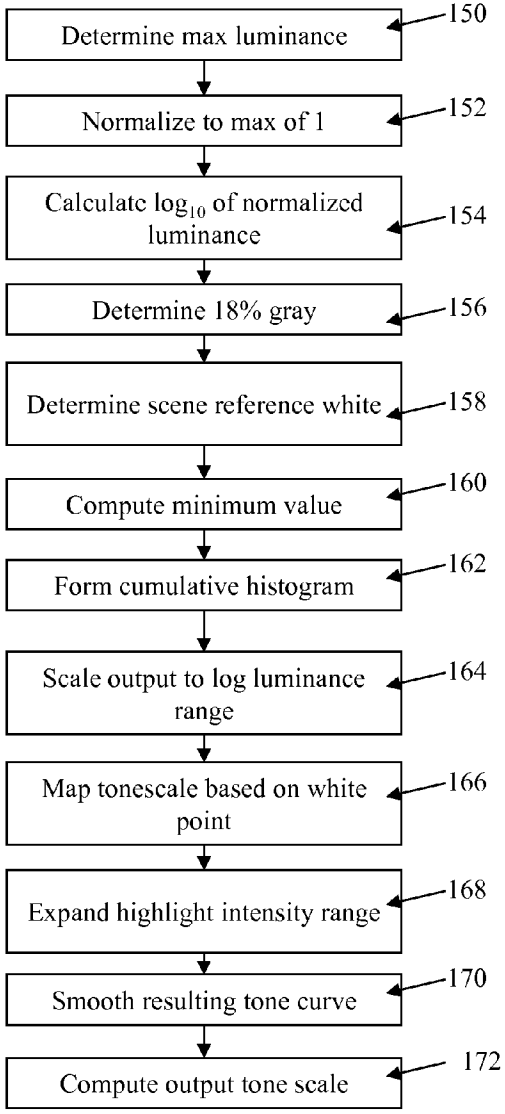
FIG. 8 is a flow diagram depicting a set of steps useful in determining an aim tonescale in an embodiment of the present invention.

To complete the determine tone scale step 140 of FIG. 7 for this input image, the steps shown in FIG. 8 can be performed. First, the maximum of the luminance value within the scene is determined (step 150). The input image signal values are then normalized (step 152) to a maximum scene luminance value of 1 by dividing the three-component input image signal values by the maximum luminance value. The base 10 logarithm of the normalized values is then calculated (step 154). The value corresponding to 18% gray in the image is determined (step 156) by calculating the average of the normalized log luminance value. The resulting value is then assumed to correspond to the 18% gray level within the image. The luminance of a perfect white diffuser in the scene, referred to henceforth as the scene reference white, is determined (step 158) by assuming that the 18% gray level has a corresponding L* value of 50 and the diffuse white reflector in the scene should have an L* value of 100. By applying this relationship, it can be determined that the diffuse white reflector in the scene should have a value that is 5.5 times the value of the 18% gray level. Therefore, the 18% gray level is multiplied by 5.5. After these calculations have been performed for the Bar Harbor image, the maximum luminance value within this particular input image signal is 1. The 18% gray point in the image is determined to have a relative luminance of 0.0043 and the scene reference white is determined to have a value of 0.0235. Within this embodiment, the scene reference white provides a demarcation between the image range and the highlight range. Notice that, based upon these calculations, the maximum luminance value in the scene is more than 40 times higher in luminance than the scene reference white and therefore the image contains significant information within the highlight range.

Figure 9:
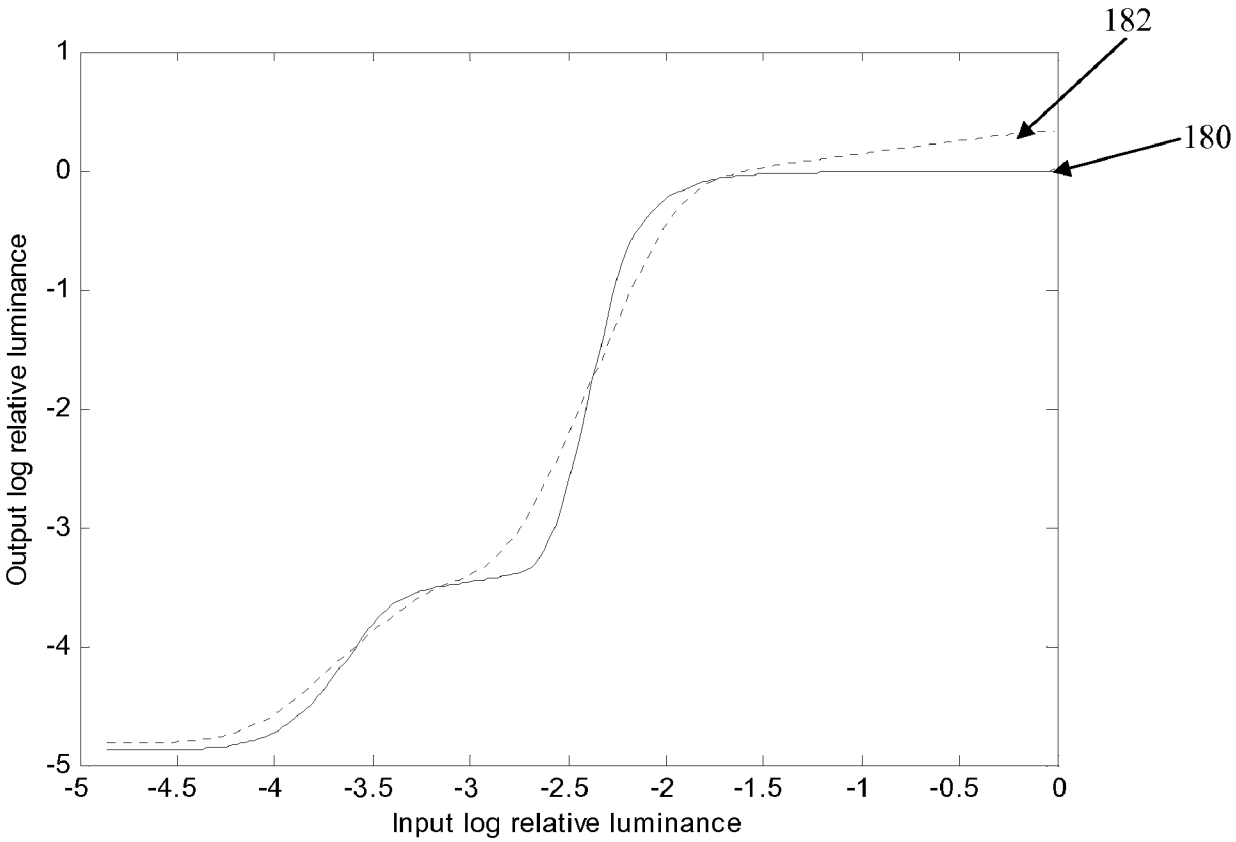
FIG. 9 is a graph depicting a tonescale without highlight information and an alternate tonescale including highlight information useful in practicing the present invention.

The minimum normalized log scene luminance value is then computed (step 160). For this example, this value is −4.87 for the Bar Harbor scene of this example. A cumulative histogram is then formed (step 162) for the entire range of normalized base 10 logarithms of the luminance values from the minimum value to 0. The cumulative probability values are then scaled (step 164) to cover the entire log luminance range of the scene, thus providing an input to output relationship for log luminance values and providing a base tone scale. The resulting curve for the input image is shown as 180 in FIG. 9. The white point is then mapped (step 166) through this base tone scale and the tone scale is normalized such that the white point is assigned an output relative luminance value of 1 (i.e., has a $\log_{10}$ value of 0). The highlight range (i.e., log 10 values greater than 0) is then expanded (step 168) to include a maximum value equal to the log 10 of the ratio of the maximum luminance of the white light-emitting element to the sum of the corresponding luminance values of the red, green, and blue light-emitting elements that can be used to achieve the white point of the display (i.e., log 10(1000 cd/m$^2$ divided by 445 cd/m$^2$)). This expansion might include mapping these values through, for example a linear function from 0 to the log 10 of this ratio or might include other nonlinear solutions. The resulting curve is then smoothed or limits are applied to the minimum and maximum slopes of the curve to compute (step 170) an output tone scale curve. This step of modifying the tone scale of the image enhances the tone-scale of the resulting rendered image. The resulting curve is shown as 182 in FIG. 9. Notice that this curve has a maximum relative luminance of 2.13 (e.g., a relative log luminance of 0.33), which is substantially higher than the relative luminance value of 1 (e.g., a relative log luminance of 0) corresponding to the scene reference white. Such methods for limiting the slopes of an output tone scale are well known in the art and have been described by others, including Lee in U.S. Pat. No. 6,717,698, entitled "Tone scale processing based on image modulation activity". The full relative luminance tone scale curve can then be computed (step 172) by fitting a spline through the output tone scale and using this spline to determine output values for all possible input values. This step completes the determine tone scale step 140 of FIG. 7

The luminance values in the input image signal can then be mapped through the tone scale according to step 142 in FIG. 7. For the image of this example, this can be accomplished by converting the luminance portion of the three-component input image signal to a tone-mapped input image signal by performing a lookup function to determine the output for every luminance value in the input image signal. The ratio of the output luminance to the input luminance is then determined for the luminance component of each input image signal. Finally the X and Z values in the input image signal are multiplied by this ratio to determine the output X and Z values in the output three-component image signal, completing step 142 of FIG. 7.

Once step 142 of FIG. 7 is complete, the three-component output image signal can be converted (step 144) to a four-component signal. This step can be accomplished using conversion techniques such as described by Murdoch et al. in U.S. Pat. No. 6,897,876, published May 24, 2005 and entitled "Method for transforming three color input signals to four or more output signals for a color display". In this specific example, since the chromaticity coordinates of the light emitted by the white-light-emitting element are the same as the chromaticity coordinates of the display white point, this conversion can be performed by first rotating the image from XYZ tristimulus values to RGB intensity values. This can be accomplished by multiplying the tone mapped XYZ tristimulus values from step 142 by the display's primary matrix divided by 100. Using the primaries of this display the primary matrix for a display having a white point at the chromaticity coordinates of D65 can be computed as known in the art. The resulting matrix to be applied is:

$$\begin{bmatrix} 0.5948 & 0.1834 & 0.1732 \\ 0.2960 & 0.6329 & 0.0710 \\ 0.0036 & 0.0827 & 1.0019 \end{bmatrix}$$

After application of this matrix, the three-component input image signal is then normalized to provide relative RGB intensity values by dividing each of the values by the result of the value that is obtained for the white point of the display with a relative log luminance of 0. The minimum of the RGB intensity values within each triplet of values corresponding to a pixel in an image is determined. This minimum value is subtracted from each RGB value and is assigned to the fourth channel to serve as the white component in the four-component signal concluding step 144 within FIG. 7.

Figure 10:
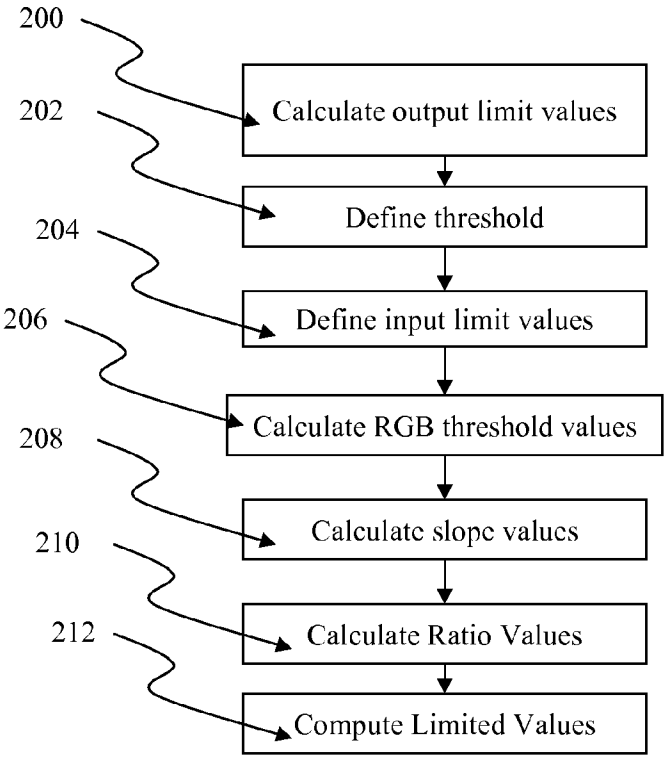
FIG. 10 is a flow diagram depicting an RGB limiting algorithm useful in limiting the intensity of red, green, and blue intensities within the highlight region of an input image.

Referring again to FIG. 7, the four-component signal is then limited (step 146 in FIG. 7). The process for performing this limiting step is shown in FIG. 10. The goal of this step is to limit the color gamut by remapping values that the display cannot produce. Specifically, in this example, the peak red, green, and blue values within the four-component image signal will be reduced within the highlight intensity range of the four component image signal to values the display can produce.

As shown in FIG. 10, output RGB limit values ($R_{Olim}$, $G_{Olim}$, $B_{Olim}$) are determined (step 200). As noted, earlier in this example, the relative scene luminance values have been mapped relative to a luminance of 445 cd/m$^2$, corresponding to the maximum luminance that can be produced at the display white point by the sum of the luminance output from the red 42, green 44, and blue 46 light-emitting elements. This luminance is the sum of 131.7 cd/m$^2$ for the red light-emitting element 42, 281.7 cd/m$^2$ for the green light-emitting element 44, and 31.6 cd/m$^2$ for the blue light-emitting element 46. However, as shown in Table 1, the red 42 and green 44 light-emitting elements can produce larger luminance values, specifically 144.9 cd/m$^2$ for the red light-emitting element 42 and 323.9 cd/m$^2$ for the green light-emitting element 44. To use the full range of each light-emitting element, the output limit values can be computed as the ratio of the maximum luminance output of each of the light-emitting elements to the luminance required from the same light-emitting element to form the maximum luminance at the display white point and this value can be used as the output RGB limit value. In this example, the values are 1.1 for the red light-emitting elements 42, 1.15 for the green light-emitting elements 44 and 1.0 for the blue light-emitting elements 46. These values are the maximum relative intensities that the display can produce.

At least one threshold value (T) is defined (step 202), which is the proportion of the maximum RGB linear intensity values at which a first slope change is to occur. In this example, it will be assumed that the threshold value will be 0.80 for all three channels. Input limit values ($R_{Ilim}$, $G_{Ilim}$, $B_{Ilim}$) are then defined (step 204). These input limit values define a maximum red, green, or blue value above which no further chromatic content will be added. For this example, this value will be assumed to be 1.5. Therefore, any red, green, or blue values within the four-component image signal having a value of 1.5 or greater will employ the maximum red, green, or blue value. RGB threshold values will then be calculated (step 206). These thresholds ($R_T$, $G_T$, $B_T$) represent the proportion of the maximum RGB value to which the output limit values, input limit values, and thresholds are mapped. The output limit values proportion ($PR_{Olim}$, $PG_{Olim}$, $PB_{Olim}$) is calculated by computing the ratio of the output limit values ($R_{Olim}$, $G_{Olim}$, $B_{Olim}$) to the maximum relative log luminance value of 2.13, providing values of 0.5164, 0.5399 and 0.4695 for the red, green, and blue respectively. The input limit value proportions ($PR_{Ilim}$, $PG_{Ilim}$, $PB_{Ilim}$) are calculated by dividing the input limit values ($R_{Ilim}$, $G_{Ilim}$, $B_{Ilim}$), which is a value of 1.5 in this example, by the maximum relative log luminance value of 2.13, providing 0.7042 for each of the red, green, and blue channels. The RGB threshold value proportions ($PR_T$, $PG_T$, $PB_T$) are calculated by multiplying the RGB threshold values ($R_T$,$G_T$, $B_T$) by the output limit values ($R_{Olim}$, $G_{Olim}$, $B_{Olim}$) and dividing the result by the maximum relative log luminance value of 2.13, resulting in values of 0.4131, 0.4319, and 0.3756 for the red, green, and blue channels.

Slopes are then calculated (step 208) for each channel. This slope represents the slope of a portion of the input-to-output limiting function having input values between the RGB threshold value proportions ($PR_T$,$PG_T$, $PB_T$) and the input-limit value proportions ($PR_{Ilim}$, $PG_{Ilim}$, $PB_{Ilim}$). This value is calculated for the red channel as shown:

$$M_R=(PR_{Ilim}-RPR_{Olim})/(PR_{Ilim}-PR_T)$$

This same calculation is performed for the green and blue channels as well by substituting green and red values for the red to obtain values $M_G$, $M_B$ as well.

A ratio value T is calculated 210 for each of the red, green, and blue values within the four-component signal. This T is the ratio of the input red, green, and blue values to the output red, green, and blue values. The value of T for the red channel is computed as:

| | |
|---|---|
| $T_R = 1$ | for $PI_R < PR_T$ |
| $T_R = PR_{Ilim} - M_R * (I_R - PR_T)$ | for $PR_T < PI_R < PR_{Ilim}$ |
| $T_R = I_R/R_{Ilim}$ | for $PI_R > PR_{Ilim}$ |

where $I_R$ is the red value within the four-component signal and PIR is the ratio of IR to the maximum relative log luminance value of 2.13. Once again, analogous calculations are performed for the green and blue converted linear intensity values to obtain $T_G$ and $T_B$ values. The limited red values are then computed (step 212) from:

$$LI_R=\min(T_R, T_G, T_B)*I_R.$$

Once again, analogous calculations are performed for the green and blue channels. The multiplication within step 212 provides scaled, converted linear intensity values and the use of the min function permits this manipulation to occur without producing hue changes in the resulting values. Through this method, the red, green and blue values are limited to the range of values that the display can physically produce. The multi-part linear functions for the ratio T permits this manipulation to be performed with reduced loss of detail as compared to a clipping function. However, some loss of detail still occurs due to the clipping of values above the input limit values. As described, the transforming step (82 in FIG. 4) includes the limiting step as detailed in FIG. 7 for limiting the maximum intensity values for driving the red, green, and blue light-emitting elements within the four-or-more-component drive signal to values less than the maximum intensity values for driving the at least one additional light-emitting elements.

Figure 11:
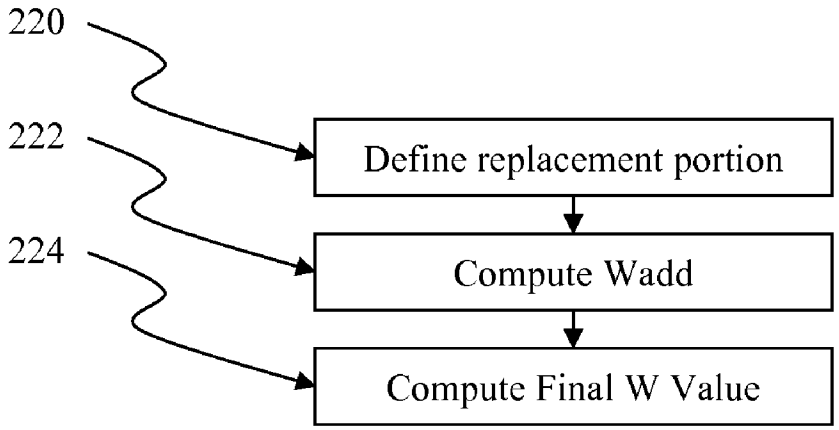
FIG. 11 is a flow diagram depicting steps useful in increasing the white intensity in response to limiting the red, green, and blue intensities.

To avoid this loss of detail the white signal is then further increased (step 148 in FIG. 7). That is, the luminance that was lost due to limiting of the color channels is at least partially replaced with luminance from the white light-emitting element 48. The process for completing this manipulation is depicted in FIG. 11. Within this process, a portion of the linear intensity to be replaced by the white channel ($W_{rep}$) is defined 220. In this embodiment, it is important that this value be very near 1, often 0.9 or greater. The value to be added to the white channel ($W_{add}$) is then computed 222 using the following equation:

$$\begin{aligned} W_{add} = (((1-\min(T_R, T_G, T_B)) * W_{rep} * I_R * L_R) + \\ ((1-\min(T_R, T_G, T_B)) * W_{rep} * I_G * L_G) + \\ ((1-\min(T_R, T_G, T_B)) * W_{rep} * I_B * L_B)) \end{aligned}$$

where $L_R$, $L_G$, and $L_B$ are the proportion of the luminance of the white point of the display produced by each of the red, green, and blue light-emitting elements 42, 44, 46, respectively. The final linear intensity value for the white channel is then computed 224 by adding $W_{add}$ to the white value within the four-component signal. Notice that through this manipulation, the spatial detail in the image that is lost while limiting the red, green, and blue signals within the four-component signal is regained. However, values within the signal that are limited, and only these values, undergo a loss of saturation. Therefore, most intensity values within the image range will not be affected by either the limiting step (146 in FIG. 7) or the increase white signal step (148 in FIG. 7). However, all of the intensity values within the highlight range will be affected by both the limiting step (146 in FIG. 7 and the increase white signal step (148 in FIG. 7). Therefore, the transforming step (82 in FIG. 4), which is expressed in more detail in FIG. 7, reduces the color saturation for triplets of image signal values within at least a portion of the highlight range but does not reduce the color saturation for triplets of image signal values within at least a portion of the image range. As most input image signals will contain relatively few, or no, triplets of intensity values within the highlight range, relatively few triplets of intensity values are affected by these steps and since most information within the highlight regions of natural images are near neutral, even fewer of the triplets of intensity values are actually desaturated to any appreciable degree. Therefore, the method of this invention provides high-dynamic-range images without an appreciable loss of color saturation within the displayed image.

In this example, the maximum luminance of the display is specified to be equal to the maximum luminance of the white-light-emitting elements, providing a dynamic range of 100,000:1 for highlight information within the scene. Further, because of the method used to convert the three-component signal to a four-component signal, the triplets of image intensity values within the image range were transformed so that the four-or-more-component drive signal causes three or fewer of the red, green, blue, and at least one additional light-emitting element to produce light and wherein at least a portion of the triplets of the image values within the highlight range are transformed such that the four-or-more-component drive signal causes each of the red, green, blue and at least one additional light-emitting element to produce light. Further in this example the input image signal specified, defined, or inferred a display white point and included triplets of image intensity values within the highlight range. The transforming step (82 in FIG. 7) included scaling triplets of image intensity values so that a triplet of image intensity values at the display white point is produced on the display with a luminance that is within 20% of the sum of the maximum luminance values of the red, green, and blue light-emitting elements. Specifically, the display white point was produced at 445 cd/m$^2$ as compared to a sum of the maximum luminance values of the red, green, and blue light-emitting elements of 500 cd/m$^2$ or within 11%.

In the method employed in this example, in response to triplets of intensity values within the highlight range, it is typical that at least one of the four-or-more-component drive signals intended to drive the red, green, and blue light-emitting elements is greater than zero and the four-or-more-component drive signals that are intended to drive at least one of the remaining of the red, green, and blue light-emitting elements equals zero. Further, the four-or-more component drive signals that are intended to drive at least one of the additional light-emitting elements is greater than zero. In this display, the peak luminance of the display will typically be equal to the maximum luminance of the additional light-emitting element, as all four of the light-emitting elements are not simultaneously employed.

Notice that by using the method as described, the white-light-emitting elements, which are the most efficient light-emitting elements, are used to produce as much of the luminance information in the image as possible without significantly reducing the color quality of the display. Therefore, it results in a display that is quite power efficient. Further, while the white light-emitting element is driven with higher currents than it would be using prior-art three-to-four-color-conversion techniques, this additional current is required only for light-emitting elements within the highlight region of any image. This number tends to be relatively small (only a few percent of all pixels) for most natural scenes, and therefore the method provides this higher dynamic range without substantial increases in current. Further, the method does not require increases in voltage to provide increases in current beyond that which would be required to drive the display to a peak luminance of 445 cd/m$^2$ using prior-art methods. Therefore, this increase in dynamic range is achieved without increases in voltage to the panel. This fact, coupled with the modest increase in average current for the display indicates that the power consumed by the display will be increased by a very modest amount, typically less than 10%, while providing a 2× increase in dynamic range.

Although it is not practical that a natural image has a large number of triplets of intensity values within the highlight range, it is possible that the three-component input image signal contain a large number of triplets within the highlight range. Under such a condition all four light-emitting elements within each pixel of the display can be driven near their maximum current. In most EL displays, such a condition will result in the buildup of heat or demand excessive amounts of power. Therefore, it is important that the present invention further include a method for limiting the peak current to the display. It should be noted that the four-component image signal contains linear intensity values, (i.e., values that are intended to be linearly related to luminance of the display). Since a linear relationship generally relates output luminance to current, each of the values within the resulting four-component image signal can be scaled by an appropriate linear relationship for each component and the result summed across groups of pixels to estimate the current required to display the four-component image signal. The result of the summation can then be compared to an aim maximum panel current and, if it exceeds the aim maximum panel current, the four-component image signal can be scaled by a common value that is less than 1. This will reduce the luminance of the output image and reduce the current and power required to present the image on the display. This common value can be computed as the ratio of the maximum current to the summed current. These steps provide an automatic current limiting algorithm to reduce the luminance of the display in response to scenes having a large number of high-input intensity values. By incorporating these steps within the transforming step (82 of FIG. 4), the transforming step further includes an analysis of the total current of the display and a reduction of the image signal values to limit the maximum current of the display device to a value less than required for every light-emitting element in the display to simultaneously produce its maximum luminance value.

It is notable that in this example, the input image signal specifies, defines, or infers a display white point color and luminance, specifically, a display white-point color and luminance are inferred from the statistics of the images. Other image formats, such as ITUR BT709-5 specifies the display white-point color and infers a luminance. Further, in this example, the display white point can be produced with the sum of the maximum luminance values of two or fewer of the red, green, and blue light-emitting elements and less than the maximum luminance of the remaining of the red, green, and blue light-emitting element. Specifically, in this example the maximum luminance of the blue light-emitting element is used to create the display white point with red and green luminance values that are less than the maximum red and green luminance values. Further, a portion of the triplets of image intensity values within the highlight range would be produced with the maximum luminance of the remaining of the red, green, and blue light-emitting elements, specifically green highlights would employ the maximum luminance of the green light-emitting elements, red highlights would employ the maximum luminance of the red light-emitting element, and yellow highlights would employ the maximum luminance of the green and red light-emitting elements.

It is also worth noting that this example provides the majority of its calculations in log luminance, which is perceptually more uniform than luminance. However, the algorithm can also be applied in other color spaces, including even more visually relevant color spaces, such as CIE lightness (L*) or CIE CAM 02 brightness.

This example provides a method for converting a three-component input image signal to a four-or-more-component image signal. This method includes providing an electroluminescent display having a plurality of light-emitting elements for emitting red, green, and blue light and at least one additional light-emitting element for emitting at least one additional color of light, the luminance of the light being responsive to a current provided to each light-emitting element; and one-or-more circuits for controlling the current to each light-emitting element, the circuits providing a maximum current to each light-emitting element to cause each light-emitting element to produce a maximum luminance value, wherein the maximum luminance value of the at least one additional light-emitting element is greater than the maximum luminance value of at least one of the red, green, or blue light-emitting elements. The method further includes providing one or more display drivers for receiving a three-component input image signal, transforming the three-component input image signal to a four-or-more-component drive signal, and providing the four-or-more-component drive signal to the one or more circuits to control the current to each light-emitting element, each of the four-or-more-component drive signals providing a signal for driving either a red, green, blue, or an additional light-emitting element. In this method, the input image signal includes a triplet of intensity values, the intensity values having at least an image range and a highlight range, the smallest intensity value of the highlight range being greater than the greatest intensity value of the image range; and the transforming step transforms at least one of the triplets having an intensity value within the image range to drive signals that produce a luminance less than the sum of the maximum luminance values of the red, green and blue light-emitting elements and transforms at least one of the intensity values having an intensity value within the highlight range to drive signals that produce a luminance greater than the sum of the maximum luminance of the red, green, and blue light-emitting elements.

As noted, earlier in the example that was provided, all four light-emitting elements are typically not driven simultaneously and the maximum luminance of the display is equal to the maximum luminance of the white light-emitting element. As noted, this results in a power efficient drive method. However, in applications where peak luminance is much more important than power efficiency, it is possible to drive all of the light-emitting elements simultaneously to produce the highest possible luminance within the highlight region. Although such a method will require higher power consumption, peak luminance values could be as high as 1500 cd/m$^2$ for the display in the previous example, providing a dynamic range as high as 150,000:1. This can be achieved using the method above by substituting the aim peak luminance of 1500 cd/m$^2$ into the method, instead of an aim peak luminance of 1000 cd/m$^2$. In this method, in response to a triplet of intensity values within the highlight range, each of the four-or-more-component drive signals that are intended to drive the red, green, and blue light-emitting elements will be greater than zero; and the four-or-more component drive signals that are intended to drive at least one of the additional light-emitting elements will be greater than zero.

In digital systems that are typically employed, the drive signals will be digital signals. As the additional light-emitting element has a larger luminance range than the red, green, or blue light-emitting elements it is desirable that the drive signal for the additional light-emitting element have a greater bit-depth than the drive signal for the red, green, or blue light-emitting elements.

Referring again to FIG. 6, the display in this example provides different colors of light emission by using color filters 104, 106, and 108 to filter the light emitted from a white EL light-emitting layer 118. However, this is not required and different colors of light emission and white light emission can be provided through various techniques, for example including patterning of different light-emitting materials within the light-emitting layer, using multiple layers of light-emitting materials, and using optical structures to tune wavelength bands of the emitted light. As shown in FIG. 6, the EL display includes a substrate 100, typically formed of a transparent material such as glass. However, the current invention is not limited to the use of glass as a substrate material and other materials, including plastics or stainless steel can be applied. Further, it is not required that the light 126 be emitted through the substrate 100 as shown in FIG. 6. Other structures, such as top-emitting structures can also be applied to permit light to exit through other surfaces of the display device. The electrode layers 112, 124 can be formed from materials such as thin (less than 500 angstroms) layers of silver, ITO or IZO to create transparent electrodes. However, the electrode layers 112, 124 can alternately be formed from reflective materials, such as layers of aluminum or silver. In further embodiments, this electrode layer 112 can include multiple overlapping or non-overlapping layers. For example, reflective materials, such as aluminum or silver can be applied over any light-emitting element for emitting a saturated color and transparent materials, such as ITO or IZO, can be applied over any light-emitting element for emitting a broad frequency spectrum, such as is required for forming a white-light-emitting element. Note that when light is emitted through semi-reflective electrodes, such as aluminum or silver, a microcavity can be formed for providing additional color filtering. This transparent layer can overlap the reflective portion, but this is not necessary.

As discussed earlier, the three-component input image signal 22 in FIG. 2 includes one or more triplets of intensity values, the intensity values having at least an image range and a highlight range, the smallest intensity value of the highlight range being greater than the greatest intensity value of the image range. That is to say, the three-component input image signal 22 will include information regarding object reflectance values within the scene and the highlights within a scene having a luminance or relative luminance value that is higher than the luminance or relative luminance of a white diffuser within the scene. Although the earlier examples received such a signal as images encoded in OpenEXR, other file formats can be used, including ITUR BT709-5, xvYCC as described by the International Electrotechnical Commission in IEC 61966-2-4 entitled "Multimedia systems and equipment—Colour measurement and management—Part 2-4: Colour management—Extended-gamut YCC colour space for video applications—xvYCC". However, it is preferred that such color spaces permit the encoding of the entire highlight range, whenever possible.

As described in the examples of this disclosure, the one or more drivers 16, 18, 20 can include a digital signal processor 20. In the present invention, this digital signal processor 20 can be a field programmable gate array, application-specificintegrated circuit or a general microprocessor capable of conducting the processing steps necessary to perform the transform step 86.

It should be noted that in addition to receiving a three-component input image signal including a triplet of intensity values, the intensity values having at least an image range and a highlight range, the smallest intensity value of the highlight range being greater than the greatest intensity value of the image range, the display system 12 of the present invention can be used to display graphics or other scenes that do not include highlight information. In such cases, algorithms can be used to detect the presence of graphical images or other non-high-dynamic-range input signals and to apply a more traditional image processing path for these images. Alternatively, the image type can be provided to the display to alter the image processing path. Therefore the display system 12 can additionally receive an input image signal and transform the three-component input image signal 22 to a four-or-more-component drive signal that produces all luminance values at or less than the sum of the maximum luminance values of the red, green and blue light-emitting elements.

The invention has been described in detail with particular reference to certain preferred embodiments thereof, but it will be understood that variations and modifications can be effected within the spirit and scope of the invention.

PARTS LIST

2 curve
4 point of maximum highlight value
6 scene white point
12 electroluminescent display system
14 electroluminescent display
16 row driver
18 column driver
20 digital signal processor
22 input image signal
24 analog signal
26 analog signal
28 timing signal
30 four-or more component drive signal
40 portion of electroluminescent display
42 red light-emitting element
44 green light-emitting element
46 blue light-emitting element
48 additional light-emitting element
50 circuit for red light-emitting element
52 circuit for green light-emitting element
54 circuit for blue light-emitting element
56 circuit for the additional light-emitting element
58 select TFT
60 row line
62 data line
64 capacitor
66 power TFT
68 power line
70 capacitor line
Parts List con'd
80 receive three-component signal step
82 provide light-emitting elements step
84 control current step
85 transform intensity values in image range step
86 transform step
87 transform intensity values in highlight range step
88 provide four-or-more-component drive signal step
90 chromaticity coordinate of red light-emitting element
92 chromaticity coordinate of green light-emitting element
94 chromaticity coordinate of blue light-emitting element
96 color gamut boundary
97 chromaticity coordinate of the additional white light-emitting element
98 chromaticity coordinate on the color gamut boundary
99 chromaticity coordinate outside the color gamut boundary
100 substrate
102 active-matrix layer
104 color filter
106 color filter
108 color filter
110 transparent element
112 electrode layer
114 pixel definition layer
116 hole transport layer
118 light-emitting layer
120 electron transport layer
122 second electrode layer
124 encapsulation layer
126 light direction
140 determine tone scale step
142 map input image signal step
Parts List con'd
144 convert input image signal step
146 limit step
148 increase white signal step
150 determine maximum luminance value step
152 normalize image signal values step
154 calculate base 10 logarithm step
156 determine gray value step
158 determine scene reference white step
160 compute minimum normalized log scene luminance step
162 form cumulative histogram step
164 scale output to log luminance step
166 map tone scale white point step
168 expand highlight intensity range step
170 compute and smooth output tone curve
172 compute full relative luminance tone scale curve step
180 initial tone scale
182 output tone scale curve
200 determine output RGB limit values step
202 define threshold value step
204 define input limit values step
206 calculate RGB threshold values step
208 calculate slope values step
210 calculate ratio values step
212 compute limited values step
220 define portion of luminance to replace step
222 add value to white channel step
224 compute final linear intensity value step

The invention claimed is:

1. A method of controlling an electroluminescent display system that receives a three-component input image signal having triplets of intensity values, the intensity values having at least an image range and a highlight range, the smallest intensity value of the highlight range being greater than the greatest intensity value of the image range, including:

(a) providing a plurality of light-emitting elements for emitting red, green, and blue light and at least one additional light-emitting element for emitting at least one additional color of light, the luminance of the emitted light being responsive to a current provided to each light-emitting element; and (b) controlling the current to each light-emitting element to cause each light-emitting element to produce a corresponding luminance value, wherein the corresponding luminance value of the at least one additional light-emitting element is greater than the corresponding luminance value of at least one of the red, green, or blue light-emitting elements at the same current;

(c) transforming the received three-component input image signal to a four-or-more-component drive signal and providing the four-or-more-component drive signal to control the current to each light-emitting element; and (i) transforming at least one of the triplets having an intensity value within the image range to a four-or-more-component drive signal to produce a luminance less than the sum of the corresponding luminance values of the red, green and blue light-emitting elements; and (ii) transforming at least one of the intensity values within a triplet having an intensity value within the highlight range to a four-or-more-component drive signal to produce a luminance greater than the sum of the corresponding luminance values of the red, green, and blue light-emitting elements, wherein the four-or-more-component drive signal is a digital signal and the drive signal for the additional light-emitting element has a greater bit-depth than the drive signal for the red, green, or blue light-emitting elements.

2. The method of claim 1, wherein the at least one additional light-emitting element emits white light.

3. The method of claim 1, wherein transforming at least one of the triplets further includes limiting the four-or-more component drive signal for driving the red, green, and blue light-emitting elements to values less than the four-or-more component drive signal for driving at least one of the one or more additional light-emitting elements.

4. The method of claim 3, wherein transforming at least one of the triplets further includes increasing the four-or-more component drive signals for driving at least one of the one or more additional light-emitting elements as a function of a reduction in the four-or-more component drive signals for driving the red, green, and blue light-emitting elements that results from the limiting step.

5. The method of claim 1, wherein transforming at least one of the triplets further includes enhancing the tone-scale.

6. The method of claim 1, wherein in response to a triplet of intensity values within the highlight range:

(a) at least one of the four-or-more-component drive for driving the red, green, and blue light-emitting elements is greater than zero and the four-or-more-component drive signal for driving at least one of the remaining red, green, or blue light-emitting elements equals zero; and (b) the four-or-more component drive signal for driving at least one of the one or more additional light-emitting elements is greater than zero.

7. The method of claim 1, wherein in response to a triplet of intensity values within the highlight range:

(a) each of the four-or-more-component drive signals for driving the red, green, and blue light-emitting elements is greater than zero; and (b) the four-or-more component drive signals for driving at least one of the one or more additional light-emitting elements is greater than zero.

8. An electroluminescent display system for receiving a three-component input image signal having triplets of intensity values, the intensity values having at least an image range and a highlight range, the smallest intensity value of the highlight range being greater than the greatest intensity value of the image range, including:

(a) an electro-luminescent display comprising:

(i) a plurality of light-emitting elements for emitting red, green, and blue light and at least one additional light-emitting element for emitting at least one additional color of light, the luminance of the light being responsive to a current provided to each light-emitting element;

(ii) one or more circuits for controlling the current to each light-emitting element, the circuits providing a current to each light-emitting element to cause each light-emitting element to produce a corresponding luminance value, wherein the corresponding luminance value of the at least one additional light-emitting element is greater than the corresponding luminance value of at least one of the red, green, or blue light-emitting elements at the same current;

(b) one or more display drivers responsive to the received three-component input image signal for transforming the three-component input image signal to a four-or-more-component drive signal and providing the four-or-more-component drive signal to the one or more circuits to control the current to each light-emitting element; and (c) wherein the display driver(s) transforms at least one of the triplets having an intensity value within the image range to a four-or-more-component drive signal that produces a luminance less than the sum of the corresponding luminance values of the red, green and blue light-emitting elements and transforms at least one of the intensity values within a triplet having an intensity value within the highlight range to a four-or-more-component drive signal that produces a luminance greater than the sum of the corresponding luminance values of the red, green, and blue light-emitting elements, wherein the four-or-more-component drive signal is a digital signal and the drive signal for the additional light-emitting element has a greater bit-depth than the drive signal for the red, green, or blue light-emitting elements.

9. The electroluminescent display system of claim 8, wherein the corresponding luminance value of the at least one additional light-emitting element is greater than the sum of the corresponding luminance values of the red, green, and blue light-emitting elements.

10. The electroluminescent display system of claim 8, wherein the additional light-emitting element emits substantially white light.

11. The electroluminescent display system of claim 8, wherein at least one triplet of image signal values is rendered to have a luminance that is at least 2 times higher than the sum of the corresponding luminance values of the red, green, and blue light-emitting elements.

12. The electroluminescent display system of claim 8, wherein the one or more display drivers adjust the four-or-more-component drive signal to cause the reduction of the color saturation for triplets of image signal values within at least a portion of the highlight range but do not cause the reduction of the color saturation for triplets of image signal values within at least a portion of the image range.

13. The electroluminescent display system of claim 8, wherein the one or more display drivers analyze the total current of the display and adjust the four-or-more-component drive signal to cause a reduction of the image signal values to limit the current of the display device.

14. The electroluminescent display system of claim 8, wherein the one or more display drivers adjust the four-or-more-component drive signal to cause the triplets of image intensity values within the image range to be transformed so that the four-or-more-component drive signal causes three or fewer of the red, green, blue, and at least one additional light-emitting element to produce light and wherein at least a portion of the triplets of the image intensity values within the highlight range are transformed such that the four-or-more-component drive signal causes each of the red, green, blue and at least one additional light-emitting element to produce light.

15. The electroluminescent display system of claim 8, wherein the three-component input image signal provides information defining a display white point and includes triplets of image intensity values within the highlight range and wherein the one or more display drivers adjust the four-or-more-component drive signal to scale triplets of image intensity values so that a triplet of image intensity values at the display white point is produced on the display with a luminance that is within 20% of the sum of the maximum luminance values of the red, green, an blue light-emitting elements.

16. The electroluminescent display system of claim 8, wherein the one or more display drivers adjust the four-or-more-component drive signal to limit the maximum intensity values for driving the red, green, and blue light-emitting elements within the four-or-more component drive signal to values less than the maximum intensity values for driving the at least one additional light-emitting elements.

17. The electroluminescent display system of claim 8, wherein the one or more display drivers adjust the four-or-more-component drive signal to provide a tone-scale enhancement.

18. The electroluminescent display system of claim 8, wherein the efficiency of the at least one additional light-emitting elements is greater than the efficiency of the red, green, and blue light-emitting elements.

* * * * *